US005542598A

United States Patent [19]

Capo

[11] Patent Number: 5,542,598

[45] Date of Patent: Aug. 6, 1996

[54] CARTON HAVING A PERFORATED ACCESS OPENING

[75] Inventor: James L. Capo, Middletown, Ohio

[73] Assignee: James River Corporation of Virginia, Richmond, Va.

[21] Appl. No.: 431,768

[22] Filed: May 1, 1995

[51] Int. Cl.[6] ..... B65D 5/72

[52] U.S. Cl. ..... 229/242; 221/45; 221/305; 229/125.33

[58] Field of Search ..... 221/305, 45, 48, 221/63; 229/240, 242, 125.33

[56] References Cited

U.S. PATENT DOCUMENTS

| | | | |
|---|---|---|---|
| 1,824,862 | 9/1931 | Young | 229/242 X |
| 3,019,944 | 2/1962 | Nelson et al. . | |
| 3,115,273 | 11/1964 | Cote | 229/242 |
| 3,168,976 | 2/1965 | Metzger | 229/242 |
| 3,239,097 | 3/1966 | Bates et al. . | |
| 3,255,948 | 6/1966 | Buttery . | |
| 3,257,028 | 6/1966 | Metzger . | |
| 3,258,156 | 6/1966 | Smith | 229/242 X |
| 3,325,003 | 6/1967 | Bilezerian | 229/242 X |
| 3,685,648 | 8/1972 | Heller . | |
| 3,829,006 | 8/1974 | Spiegel | 229/242 X |
| 3,940,054 | 2/1976 | Goebel | 229/125.33 |
| 4,044,919 | 8/1971 | Olson | 229/242 |
| 4,163,508 | 8/1979 | Mannor . | |
| 4,200,200 | 4/1980 | Hein | 211/48 |
| 4,318,474 | 9/1982 | Hasegawa | 229/237 X |
| 4,834,244 | 5/1989 | Masui | 229/237 |
| 4,946,042 | 8/1990 | Ferreri et al. . | |
| 5,219,421 | 6/1993 | Tipping | 221/305 X |

FOREIGN PATENT DOCUMENTS

| | | | |
|---|---|---|---|
| 4006224 | 8/1995 | Denmark | 229/242 |

*Primary Examiner*—Gary E. Elkins

*Attorney, Agent, or Firm*—Sixbey, Friedman, Leedom & Ferguson, P.C.; Charles M. Leedom, Jr.; Donald R. Studebaker

[57] ABSTRACT

A carton and blank for forming such carton are disclosed including a top wall, a bottom wall and a plurality of sidewalls extended upwardly from the bottom wall to the top wall. An access opening is preferably formed in the top wall, but may be formed in any one of the sidewalls and is defined by at least one line of weakness with the line of weakness including at least one through cut line and a plurality of perforated lines extending in a linear or curvilinear direction. The perforated lines formed adjacent each end of the through cut line extend in substantially the same direction as the through cut. The access opening preferably includes two mutually opposing lines of weakness which extend from mutually opposing void regions formed in the top panel of the carton with the lines of weakness including a plurality of through cut lines and a plurality of perforated line sections with each of the perforated lines section including at least two perforated lines with the perforated lines being positioned collinear with the through cut lines.

23 Claims, 3 Drawing Sheets

CARTON HAVING A PERFORATED ACCESS OPENING

TECHNICAL FIELD OF THE INVENTION

The present invention is directed to a carton having a perforated access opening for permitting access to the contents of the carton. More particularly, the present invention is directed to the formation of a line of weakness defining the access opening for permitting the reliable removal of such access opening when access to the contents of the carton is desired.

BACKGROUND OF THE INVENTION

Paperboard products having weakened severance lines or lines of weakness which may be readily torn apart are used throughout the paperboard carton industry. To form such severance lines, a cutting tool is generally used having an interrupted cutting edge. When the tool is applied to a sheet of paperboard, a series of short, aligned, spaced apart cuts in the form of perforations passing through the paperboard are formed. The paperboard is subsequently torn along the line of weakness, and in the case of a carton having an access opening in a top panel thereof defined by the line of weakness permits the access opening to be torn out by applying an upward force on the access panel. Although the type of severance line discussed hereinabove is satisfactory for many applications, its use presents numerous problems when certain types of paperboard are used, when it is desired to achieve a clean severance of the access opening or when the line of weakness is of a high degree of curvature.

When paperboard material having a strong outer surface layer which is somewhat stronger than the remainder of the thickness of the paperboard material, that is when a paperboard material having a decorative coating on the outer surface thereof is used, or when some of the fibers of the paperboard material are oriented transversely with respect to the line of perforations, a clean separation at the perforations may not occur, thus resulting in the paperboard peeling in an area outside the access opening defined by the line of weakness. Moreover, when the severance line is of a high degree of curvature, the portion of the paperboard material between the perforations at a high degree of curvature may continue outwardly through the top surface of the carton thereby destroying the decorative outer surface.

One solution to the above-noted problem is to provide a line of weakness formed of a series of perforations passing completely through the paperboard material along with secondary cuts which pass only partially through the surface of the board. This type of severance line has proved to overcome some of the above-noted shortcomings; however, the formation of such line on a mass production basis has proven to be difficult. That is, such a severance line must be formed by a single a tool having a series of extended spaced blade elements for forming the perforations which extend through the paperboard material along with recessed blade elements interspersed therebetween in alignment with the extended blade elements but which do not pass completely through the paperboard material. Such a cutting tool is difficult and expensive to manufacturer. Moreover, such a cutting tool is readily damaged during use and requires frequent service.

In an effort to overcome such shortcomings, a cutting tool of the type set forth in U.S. Pat. No. 3,255,948 was designed to form a line of weakness in the paperboard material which includes a substantially continuous line which is severed part way through the paperboard material with adjacent perforations being formed therein as well. In doing so, the entire outline of the access opening is severed which prevents the tears between perforations from propagating outside the confines of the access opening; however, such a continuous cut line may weaken the paperboard material about an entire periphery of the access opening which may result in an inadvertent opening of the carton.

Formation of the line of weakness set forth in U.S. Pat. No. 3,019,944 includes inner and outer partial cut scores which are formed in a substantially continuous manner in both the inner surface and outer surface of the top panel of a carton for dispensing flexible sheets. The inner and outer line of weaknesses are spaced from one another a short distance such that when a force is applied to the access opening, ply separation of the paperboard material occurs between the two partial cut scores, thus permitting the removal of the access opening. While this substantially eliminates the possibility of defacing the remaining portion of the top panel, when the access panel is removed, the ply separation, which occurs between the inner and outer partial cut scores, is exposed when the access panel is removed, thus leaving a non-decorative portion of the top panel exposed, which significantly degrades the aesthetics of the carton.

Clearly, there is a need for a carton having an access opening defined by a line of weakness which is both aesthetically pleasing when the carton is in the unopened condition and which provides for a reliable separation of the access opening from the remainder of the carton without defacing the remaining portions of the carton or leaving portions of the inner-ply of the carton exposed. Further, there is clearly a need for a line of weakness which permits the line of weakness to undergo changes in direction without resulting in the defacing of the remaining portions of the carton.

SUMMARY OF THE INVENTION

A primary object of the present invention is to overcome the shortcomings associated with the prior art as discussed hereinabove.

A further object of the present invention is to provide a line of weakness which defines an access opening in a carton which permits the access opening to be readily detached from the remaining portion of the carton without defacing such remaining portions.

Yet another object of the present invention is to provide a line of weakness which may be readily formed in a carton during the formation of the paperboard blank used to form such carton.

A further object of the present invention is to provide a line of weakness for defining an access opening in a carton wherein the line of weakness may undergo abrupt changes in direction without defacing the remaining portion of the carton when the access opening is removed from the remainder of the carton.

These, as well as additional objects of the present invention, are achieved by forming a carton from a blank, preferably formed of paperboard material wherein the blank includes a first main panel having first and second side panels and end panels hingedly connected thereto by way of fold lines, a second main panel hingedly connected to one of the first and second main panels and having end panels and a sealing panel hingedly connected thereto by way of fold lines. An access opening is formed in one of the first and second main panels with the access opening defined by at least one line of weakness including at least one through cut line and a plurality of perforated lines extending in a linear or curvilinear direction such that the perforated lines formed adjacent each end of the through cut line extend in substantially the same direction as the through cut line. The carton formed from such a blank includes a top wall, a bottom wall and a plurality of sidewalls extended upwardly from the bottom wall to the top wall. The access opening is preferably formed in the top wall, but may be formed in any one of the sidewalls and is defined by at least one line of weakness with the line of weakness including at least one through cut line and a plurality of perforated lines extending in a linear or curvilinear direction. In doing so, the perforated lines formed adjacent each end of the through cut line extend in substantially the same direction as the through cut. The access opening is preferably formed in the top panel and is defined by two mutually opposing lines of weakness which extend from mutually opposing void regions formed in the top panel of the carton with the lines of weakness including a plurality of through cut lines and a plurality of perforated line sections with each of the perforated line sections including at least two perforated lines with the perforated lines being positioned collinear with the through cut lines. With cartons having such void regions, a window formed of a thin transparent film may be adhered to an inside surface of the top wall, thus coveting the void regions, with the window including a dispensing opening in the form of an elongated slit formed in the thin transparent film which is covered by the access opening prior to its removal.

The access opening may take on any configuration with this configuration preferably being elliptical in shape or of a diamond configuration. In a case where void regions are provided, the void regions are generally positioned such that a major access of either the elliptical or diamond shaped opening bifurcates the mutually opposing void regions. Further, in the case of a diamond shaped access opening, mutually opposed through cuts formed in the lines of weakness are bifurcated by a minor access of the diamond configuration.

These, as well as additional advantages of the present invention will become apparent from the following detailed description of the invention when read in light of the several figures.

DETAILED DESCRIPTION OF THE INVENTION

Figure 1:
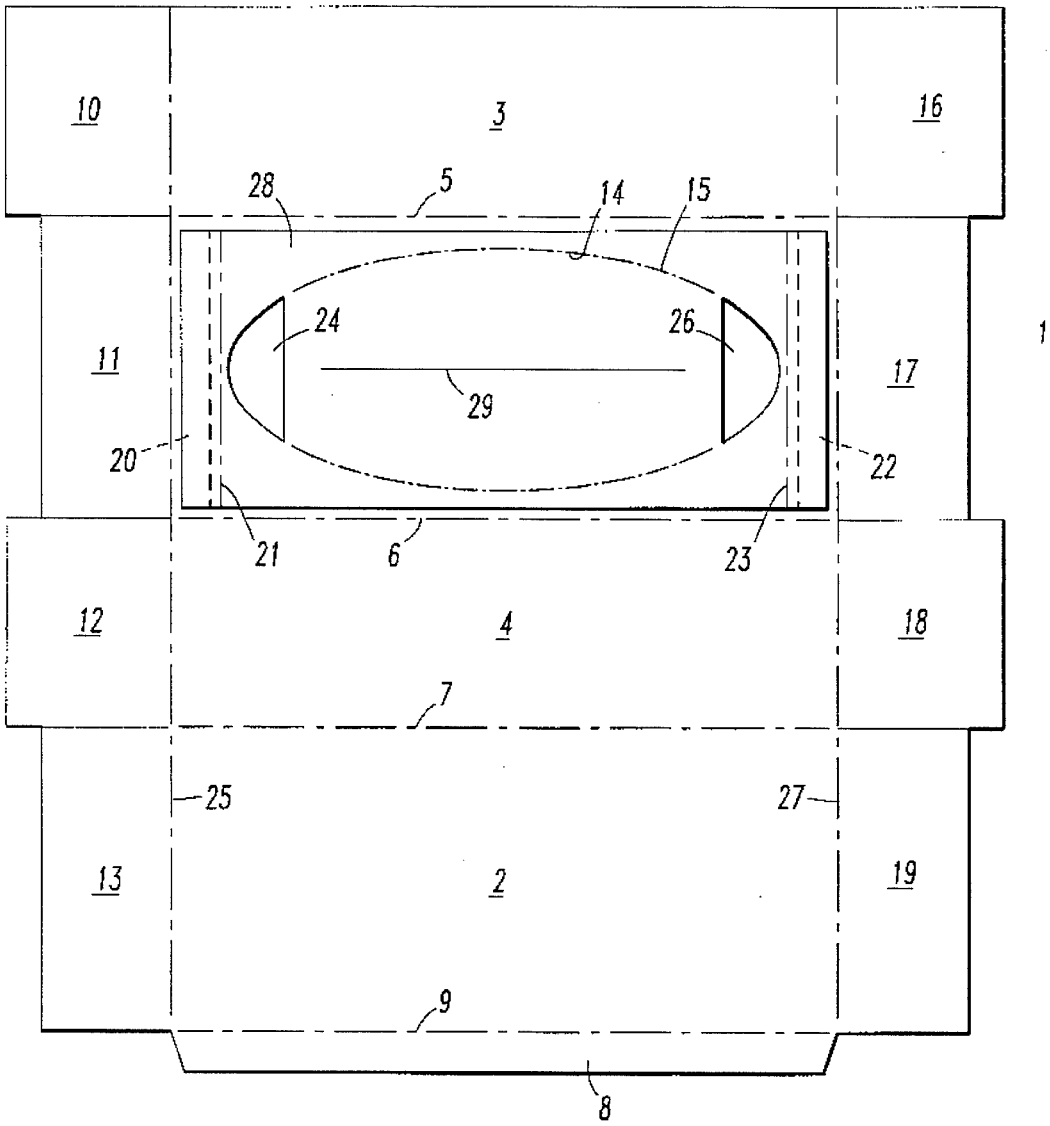
FIG. 1 is a plan view of a blank formed in accordance with the present invention.
Figure 2:
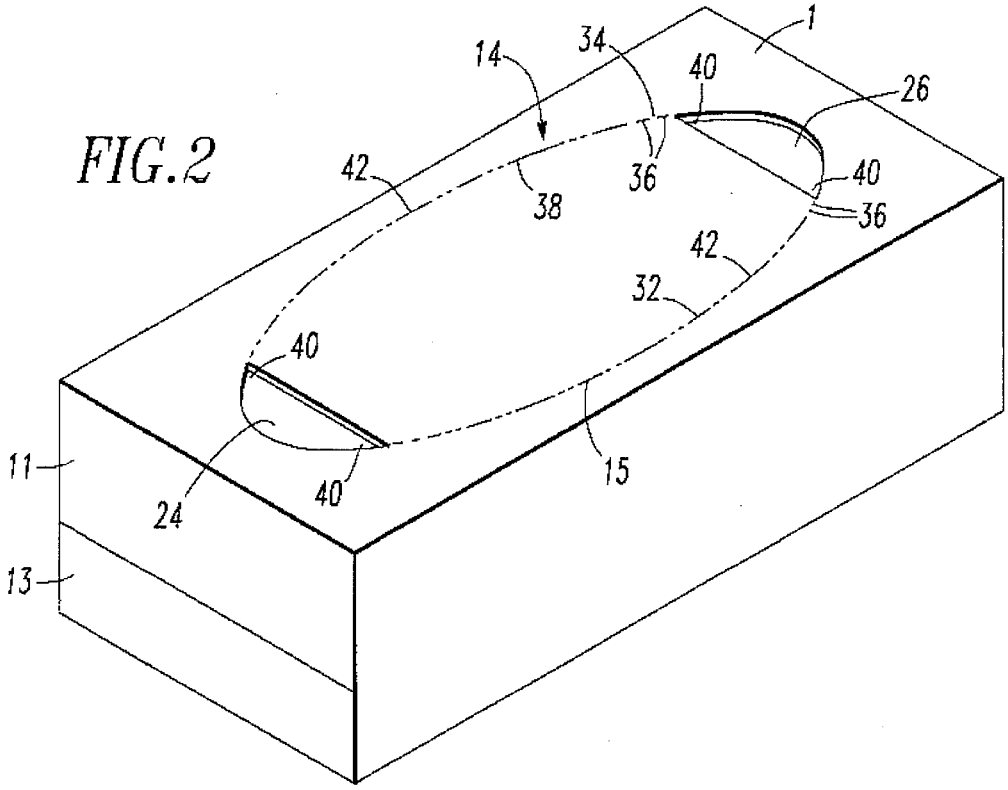
FIG. 2 is a perspective view of a carton formed from the blank illustrated in FIG. 1.

With reference to the several figures, like reference numerals will be used to define like elements in each of the disclosed embodiments. Referring initially to FIG. 1, a plan view of the inner surface of the blank for forming the carton set forth in FIG. 2 is illustrated and includes a first main panel 1 which is to form the top panel of a carton, a second main panel 2 which forms a bottom panel of the carton, side panels 3 and 4 which are hingedly connected to the first panel 1 and second panel 2 by way of fold lines 5, 6 and 7. A sealing flap 8 is also provided and hingedly connected to the second main panel 2 by way of fold line 9. Also hingedly connected to the first main panel 1, second main panel 2, and side panels 3 and 4 by way of fold lines 25 and 27 are end panels 10, 11, 12, 13, 16, 17, 18 and 19. It should be appreciated that the particular configuration of the panels illustrated in FIG. 1 may take on any form such that, when erected, form a carton from which articles may be dispensed therefrom.

An access opening 14 is provided in the first main panel 1, the outer periphery of which is defined by a line of weakness 15 which is the underlying aspect of the present invention. The particular formation of the line of weakness 15 will be discussed in greater detail hereinbelow. Cut out sections or void regions 24 and 26 are provided at mutually opposed ends of the access opening 14 which allow the user to readily grasp the access opening and remove such from the first main panel 1 when access to the contents is desired. It is to be noted that an outer surface of the paperboard blank will often include a decorative surface such as a printed pattern, descriptive material or the like, and when the access opening 14 is removed from the formed carton, it is desired that such decorative portion of the first main panel 1 remain in tact and not be destroyed by such removal.

When cut outs such as cut outs 24 and 26 are provided in the carton, it is often desired to provide a transparent film 28 which is adhesively affixed to the inner surface of the first main panel 1. The ends of the transparent film 28 which are positioned outside the area defined by the line of weakness 15 are adhesively fixed to the first main panel 1 forming narrow strips 20 and 22 which extend across the entire end of the film. Between the area of the strips 20 and 22 and the access opening 15, lines of weakness 21 and 23 in the form of perforations are provided such that the transparent film 28 may be readily removed if desired. Such a plastic window for covering cut outs in a container of this type is disclosed in U.S. Pat. No. 3,257,028 issued to Harry L. Metzger. Additionally, the transparent film 28 may include an elongated slit 29 formed therein. The transparent film is sufficiently fixable to permit the user to insert a thumb and forefinger through the elongated slot 29 for removal of either an individual sheet or a plurality of sheets. As is commonly done with tissues and other sheet-like products such as bags, the various sheets are interleaved with one another to form a stack either by inner folding of the tissue panel portions or interleaving the sheets in a Z configuration. During use, when an initial sheet is removed from the carton, a trailing sheet is partially drawn through the opening during each dispensing operation, marginal portions of the film formed by slit 29 are maintained under tension and contact the trailing sheet to minimize the opening area and grip the trailing interleaved sheet to position the trailing sheet for subsequent removal.

Referring now to FIG. 2, as is illustrated therein, the access opening 14 is formed in the now top panel 1 and is defined by the line of weakness 15. While cut outs 24 and 26 are illustrated in FIG. 2 which permit the user to view of the contents of the carton and to permit the user to readily grasp the access opening 14, such cut outs need not be present.

The line of weakness 15 may be a continuous line of weakness or may be in the form of two mutually opposed lines of weakness as illustrated in FIG. 2. That is, the embodiment illustrated in FIG. 2 includes a first line of weakness 30 and second line of weakness 32 which are mutually opposed to one another and form essentially mirror images of one another in the top panel 1 of the carton. As is illustrated in FIG. 2, the lines of weakness 30 and 32 are formed by alternating perforation regions 34 formed by a plurality of perforations 36 which extend through the entire thickness of the top panel 1. Adjacent the perforation region 34 and substantially collinear therewith are through cuts 38 of a length approximately equal to the overall length of the perforation section 34 with the through cuts extending through the entire thickness of the top panel 1. As is readily apparent from FIG. 2, each of the lines of weakness 30 and 32 include a plurality of through cuts 38 as well as a plurality of perforation sections 34 interposed therebetween.

In accordance with the present invention, the line of weakness 15 is formed of alternating perforation sections and through cuts in order to define the outer periphery of the access opening 14. In doing so, when the access opening 14 is removed by the consumer, the tearing forces are concentrated at each of the corners 40 of the cut out sections 24 and 26, respectively which initiates the tearing of the access opening 14. When the tear reaches the first through cut section, these forces are dissipated and subsequently again concentrated at the ends 42 of the through cuts which prevents the tear line from straying away from its intended course. Further, the perforations 36 of each perforation section 34 may be of any number so long as the uncut spaces between the perforations are sufficient to maintain the access opening 14 in the position illustrated in FIG. 2 until such time as the consumer wishes to remove the access opening 14.

Figure 4:
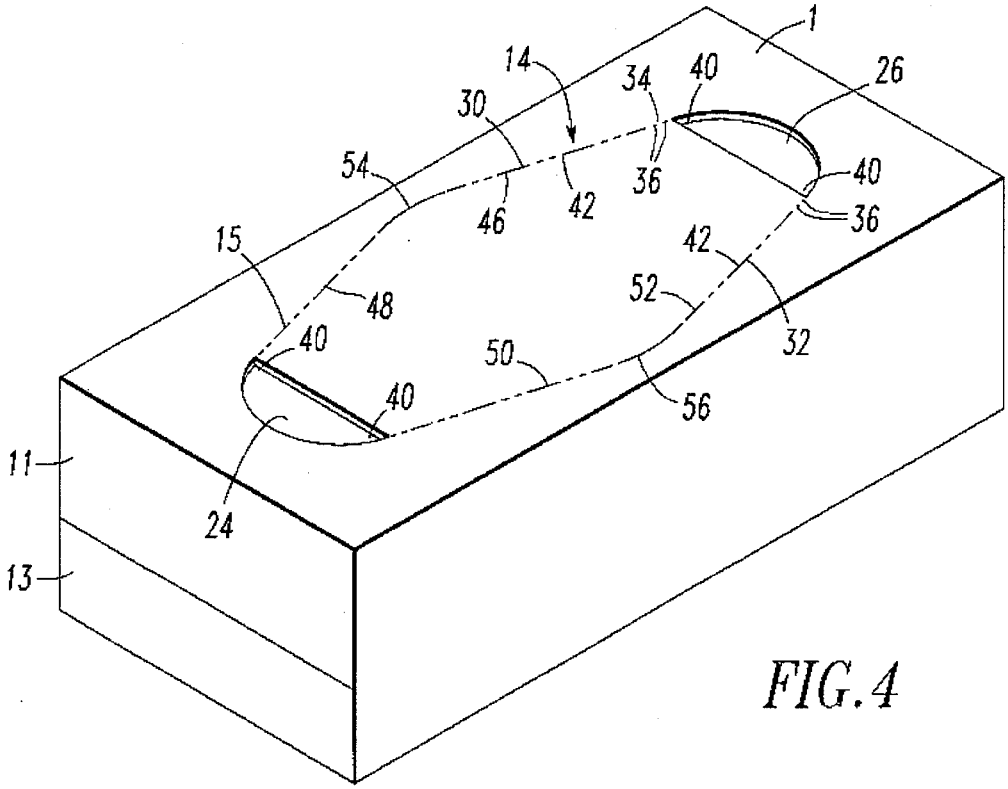
FIG. 4 is a carton formed from the blank illustrated in FIG. 3.
Figure 3:
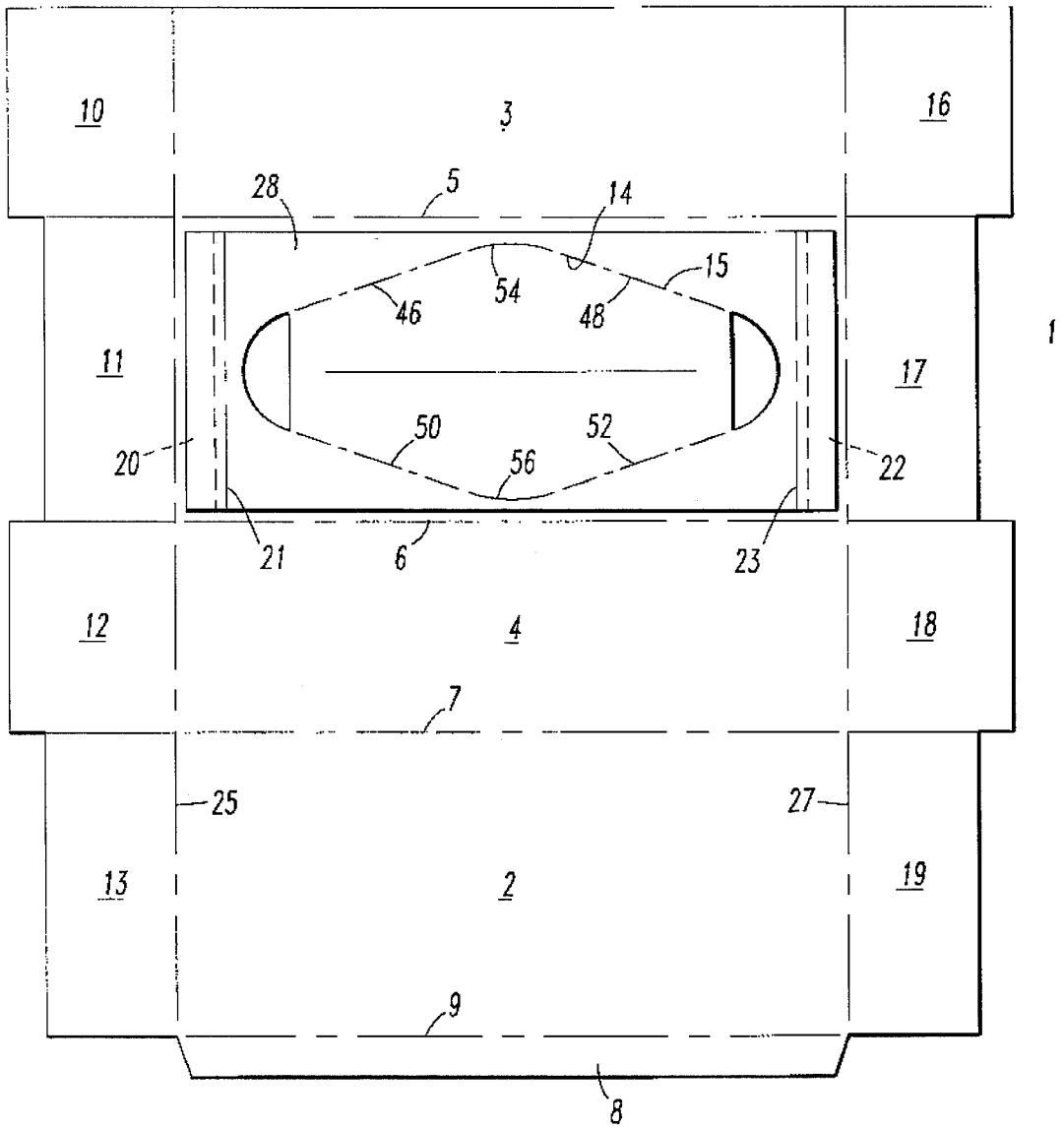
FIG. 3 is a plan view of a blank for forming a carton in accordance with an alternative embodiment of the present invention.

Referring now to FIGS. 3 and 4, a carton formed in accordance with an alternative embodiment of the present invention will be discussed in greater detail hereinbelow. Like reference numerals will be used to refer to like components to those set forth in FIGS. 1 and 2.

Initially, FIG. 3 illustrates a plan view of the inner surface of the blank for forming the carton set forth in FIG. 4 and includes a first main panel 1 which is to form the top panel of a carton formed from the blank, a second main panel 2 which forms a bottom panel of the carton and side panels 3 and 4 which are hingedly connected to the first panel 1 and second panel 2 by way of fold lines 5, 6 and 7. A sealing flap 8 is also provided and hingedly connected to the second main panel 2 by way of fold line 9. Also hingedly connected to the first main panel 1, second main panel 2, and side panels 3 and 4 by way of fold lines 25 and 27, are end panels 10, 11, 12, 13, 16, 17, 18 and 19. Again, as with FIG. 1, it should be appreciated that the particular configuration of the panels illustrated in FIG. 3 may take on any form such that, when erected, form a carton from which articles may be dispensed therefrom.

An access opening 14 is provided in the first main panel 1, the outer periphery of which is defined by a line of weakness 15 which again is the underlying aspect of the present invention. Cut out or void sections 24 and 26 are provided at mutually opposed ends of the access opening 14 which allow the user to readily grasp the access opening and remove such from the first main panel 1 when access to the contents is desired. As with the previous embodiment, when the access opening 14 is removed from the formed carton, it is desired that the decorative portion of the first main panel 1 remain in tact and not be destroyed by such removal.

Further, as with the carton illustrated in FIG. 2, it is often desired to provide a transparent film 28 which is adhesively affixed to the inner surface of the first main panel 1. The ends of the transparent film 28 which are positioned outside the area defined by the line of weakness 15 are adhesively fixed to the first main panel 1 forming narrow strips 20 and 22 which extend across the entire end of the film. Between the area of the strips 20 and 22 and the access opening 15, lines of weakness 21 and 23 in the form of perforations are provided such that the transparent film 28 may be readily removed if desired. Additionally, as with the previous embodiment, the transparent film 28 may include an elongated slit 29 formed therein which permits the user to insert a thumb and forefinger through the elongated slot 29 to remove either an individual sheet or a plurality of sheets from the carton. During use, when an initial sheet is removed from the carton, a trailing sheet is partially drawn through the opening during each dispensing operation, marginal portions of the film formed by slit 29 are maintained under tension and contact the trailing sheet to minimize the opening area and grip the trailing interleaved sheet to position the trailing sheet for subsequent removal.

Referring now to FIG. 4, as is illustrated therein, the access opening 14 is formed in the now top panel 1 and is defined by the line of weakness 15. While cut outs 24 and 26 are again illustrated in FIG. 4, such cut outs need not be present. The line of weakness 15 may be a continuous line of weakness or may be in the form of two mutually opposed lines of weakness as was the case with the embodiment illustrated in FIG. 2. That is, the embodiment illustrated in FIG. 4 includes a first line of weakness 30 and second line of weakness 32 which are mutually opposed to one another in the top panel of the carton in a diamond configuration. As with the previous embodiment, the lines of weakness 30 and 32 are formed by alternating perforation regions 34 formed by a plurality of perforations 36 which extend through the entire thickness of the top panel 1. Adjacent thereto and substantially collinear therewith are through cuts 38 of a length approximately equal to the overall length of the perforation section 34 with the through cuts extending through the entire thickness of the top panel 1. As is readily apparent from FIG. 4, each of the lines of weakness 30 and 32 include a plurality of through cuts 38 as well as a plurality of perforation sections 34 interposed therebetween, that is, the lines of weakness are formed of alternating perforation sections and through cuts in order to define the outer periphery of the access opening 14. In doing so, when the access opening 14 is removed by the consumer, the tearing forces are concentrated at each of the corners 40 of the cut out section where the consumer grasps the access opening 14, which initiates the tearing of the access opening 14. When the tear reaches the first through cut section, these forces are dissipated and subsequently again concentrated at the ends 42 of the through cuts which prevents the tear line from straying away from its intended course. Further, as with the previous embodiment, the perforations 36 of each perforation section 34 may be of any number so long as the uncut spaces between the perforations are sufficient to maintain the access opening 14 in the position illustrated in FIG. 4 until such time as the consumer wishes to remove the access opening 14.

As discussed hereinabove, the access opening 14 is defined by a line of weakness 15 which in the embodiment illustrated in FIGS. 3 and 4 extends from the mutually opposed cut out sections 24 and 26. Because the outer periphery of the access opening 14 illustrated in FIG. 3 includes linear sections 46, 48, 50 and 52, which are interconnected with one another at the curvilinear regions 54 and 56, the curvilinear regions 54 and 56 are through cut lines. Particularly, in the case of the substantially diamond like configuration illustrated in FIGS. 3 and 4, the curvilinear regions 54 and 56 are mutually opposed from one another along a minor access of the diamond configuration. In doing so, the propagation of the line of weakness along the length of the top panel 1 may readily change direction without fear of destruction to the portion of the top panel 1 outside the confines of the access opening 14.

While the present invention is described and illustrated in the form of either an elliptical or diamond shaped access opening, the access opening may take on any configuration wherein the through cut and perforation sections are alternately disposed along the perimeter defining the access opening and through cuts form the portion of the outer periphery where the line of weakness takes on an abrupt change in direction. Further, while the access opening is illustrated as being formed in the top panel 1 of each of the illustrated embodiments, the access panel may be formed in any of the panels of the carton and further may pass from one panel to another thereby forming an access opening in two or more adjacent panels.

While the present invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention shall be limited only by the appended claims.

We claim:

1. A carton for dispensing articles comprising:

a top panel;

a bottom panel;

a plurality of side panels extending upwardly from said bottom panel to said top panel; and an access opening formed in one of said panels and defined by at least one line of weakness; said line of weakness including a plurality of through cut lines and a plurality of perforated line sections, each perforated line section including at least two perforated lines with each section being positioned substantially collinear with said through cut lines;

wherein the perforated lines formed adjacent each end of said at least one through cut line extend in substantially the same direction as said at least one through cut line.

2. The carton as defined in claim 1, wherein said access opening includes two mutually opposing lines of weakness.

3. The carton as defined in claim 2, further comprising at least one void region formed in said one of said panels with said mutually opposing lines of weakness extending from said void region.

4. The carton as defined in claim 3, wherein two mutually opposing void regions are formed in said one of said panels with said mutually opposing lines of weakness extending between said void regions.

5. The carton as defined in claim 4, further comprising a window means adhered to an inside surface of said one of said panels for covering said void regions, said window means including a dispensing opening therein which is covered by said access opening.

6. The carton as defined in claim 5, wherein said window means is a thin transparent film and said dispensing opening is an elongated slit formed in said thin transparent film.

7. The carton as defined in claim 4, wherein said access opening is elliptical in shape and said mutually opposing void regions are bifurcated by a major axis of said elliptical shape.

8. The carton as defined in claim 4, wherein said access opening is of a substantially diamond configuration and said mutually opposing void regions are bifurcated by a major axis of said diamond configuration.

9. A carton for dispensing articles comprising:

a top panel;

a bottom panel;

a plurality of side panels extending upwardly from said bottom panel to said top panel; and an access opening formed in said top panel and defined by at least one line of weakness, said line of weakness extending in at least one of a linear and curvilinear direction including a plurality of through cut lines and a plurality of perforated line sections, each perforated line section including at least two perforated lines with each section being positioned substantially collinear with said through cut lines.

10. The carton as defined in claim 9, wherein said access opening is elliptical in shape.

11. The carton as defined in claim 9, wherein said access opening is of a diamond configuration.

12. The carton as defined in claim 11, wherein a minor axis of said diamond configuration bifurcates mutually opposed through cut lines of said lines of weakness.

13. The carton as defined in claim 9, wherein said access opening includes two mutually opposing lines of weakness.

14. The carton as defined in claim 13, wherein said access opening includes at least one void region formed in said top panel with said line of weakness extending from said void region.

15. The carton as defined in claim 14, wherein two mutually opposing void regions are formed in said top panel with said mutually opposing lines of weakness extending between said void regions.

16. A blank for forming a carton for dispensing articles therefrom, comprising:

a first main panel having first and second side panels and end panels hingedly connected to said first main panel by way of respective fold lines;

a second main panel hingedly connected to one of said first and said second side panels and having end panels and a sealing panel hingedly connected to said second main panel by way of respective fold lines;

an access opening formed in one of said first and second main panels, said access opening defined by at least one line of weakness including a plurality of through cut lines and a plurality of perforated line sections, each perforated line section including at least two perforated lines with each section being positioned substantially collinear with said through cut lines;

wherein the perforated lines formed adjacent each end of said through cut lines extend in substantially the same direction as said through cut lines.

17. The carton as defined in claim 16, wherein said access opening includes two mutually opposing lines of weakness.

18. The carton as defined in claim 17, further comprising at least one void region formed in said one of said first and second main panels with said mutually opposing lines of weakness extending from said void region.

19. The carton as defined in claim 18, wherein two mutually opposing void regions are formed in said one of said first and second main panels with said mutually opposing lines of weakness extending between said void regions.

20. The carton as defined in claim 19, further comprising a window means adhered to an inside surface of said one of said first and second main panels for covering said void regions, said window means including a dispensing opening therein which is covered by said access opening.

21. The carton as defined in claim 20, wherein said window means is a thin transparent film and said dispensing opening is an elongated slit formed in said thin transparent film.

22. The carton as defined in claim 21, wherein said access opening is elliptical in shape and said mutually opposing void regions are bifurcated by a major axis of said elliptical shape.

23. The carton as defined in claim 22, wherein said access opening is of a substantially diamond configuration and said mutually opposing void regions are bifurcated by a major axis of said diamond configuration.

* * * * *